United States Patent [19]

Remmey, III

[11] 3,958,816

[45] May 25, 1976

[54] NOTATION RELATED BOOK MARKERS

[76] Inventor: Robert H. Remmey, III, 7752 Fay Ave., La Jolla, Calif. 92037

[22] Filed: Mar. 21, 1975

[21] Appl. No.: 560,322

[52] U.S. Cl. ..... 283/38; 35/35 R; 281/31; 283/42

[51] Int. Cl.[2] ..... B42F 21/00

[58] Field of Search ..... 283/36–43; 281/31; 35/35 R; 40/2, 23 A

[56] References Cited

UNITED STATES PATENTS

| | | | |
|---|---|---|---|
| 1,862,530 | 6/1932 | Dickman | 281/31 X |
| 3,372,858 | 3/1968 | Brody | 281/31 X |
| 3,473,827 | 10/1969 | Leadbetter | 283/36 |
| 3,583,358 | 6/1971 | Hanson | 40/23 A X |

*Primary Examiner*—Lawrence Charles
*Attorney, Agent, or Firm*—James C. Wray

[57] ABSTRACT

In a marking apparatus and method for books, double sided tabs have adhesive so that the tabs may be adhered to pages of books, with a number-bearing portion of the tab extending from the page. Adhesive occupies one-half of one side of the tab, and numbers are written in opposite directions on opposite sides of the tab so that the tab may be affixed to a left or right page of a book to clearly mark the page and the point on the page to which it refers. Learning key cards have numbers corresponding to the tabs. Brief notes are written on the lines, and the cards are attached to the front leaf of a book. The tabs are attached directly to the learning key, or they are attached on the inside of a cover or opposite leaf of the book. An envelope or jacket-type holder is adhesive-backed for fastening to an inside of the book, and the tabs are mounted on a release coating on the outside of the envelope-pocket. Learning key cards, each with individual numbers corresponding to the tabs, are inserted in the pocket so that an entire card is available for notes in reference to the corresponding tab.

10 Claims, 10 Drawing Figures

NOTATION RELATED BOOK MARKERS

BACKGROUND OF THE INVENTION

All learning comes from organized knowledge. Psychological research has proved that learning most readily occurs when one links new ideas, information or knowledge with some experience or knowledge that he already has. Research has also shown that if one reviews what he has read within 1 hour, he will recall later up to 90%. If he reviews within 2 hours, the recall rate drops to 70%. Reviewing 4 to 8 hours later drops the recall rate still further. For best learning results, one uses the markers to identify material he wishes to learn, writes brief descriptions of that in the key in the front of the book and then 1 hour later reviews his material.

Professors and students, scientists and general readers insert many slips of paper as markers in the various books they use. Most students and other frequent users of books also identify study passages in some way, by turning down corners, by underlining with markers, or by some systematic or irregular method.

Before preparing a patent application a search was conducted in the U.S. Patent Office in Class 116, Indicators, subclass 119, Book Marks. Examples of the most pertinent which were found are:

3,583,358
3,680,229
3,324,823
2,984,205

In U.S. Pat. No. 3,583,358, colored and numbered tabs having a portion of one surface coated with an adhesive are mounted in a matchbook-like holder for separately removing the tabs and marking pages of a book. That patent does not teach the mounting of the tabs on a plate or pocket which is in turn mounted inside a cover or on a fly-leaf of a book. That disclosure does not teach the use of a learning key card or cards physically and informationally related to the tabs.

U.S. Pat. No. 3,680,229 was selected as an example of symbols related to a book appearing on a card. Those symbols are used to identify whole books and not pages, and apparently those symbols are permanent in nature. The symbols and cards of U.S. Pat. No. 3,680,229 do not suggest the present invention.

U.S. Pat. No. 3,324,823 was selected for its showing of a marker attached to a related card. The entire marker and card are integral and are inserted together within pages of a book.

U.S. Pat. No. 2,984,205 was selected for its showing of notes combined with a mark. The marker and notes are combined in use and are not the same as the present invention.

No prior art disclosure suggests the present invention.

SUMMARY OF THE INVENTION

Briefly, the invention consists of a marking apparatus and method for books. Basic to the invention are double sided tabs which have adhesive so that the tabs may be adhered to pages of books, with a number-bearing portion of the tab extending from the page. Adhesive occupies one-half of one side of the tab. Numbers are written in opposite directions on opposite sides of the tab, so that the tab may be affixed to a left or right page of a book to clearly mark the page and the point on the page to which it refers.

Included in the invention is a learning key. In one form of the invention, the learning key card is a lined card with numbers corresponding to the tabs. Brief notes are written on the lines. The card is adhesive-backed for attaching to the front leaf of a book. In that form of the invention, before use the tabs are attached directly to the learning key. In a modification, the tabs are provided on another card, which is adhesive-backed for attachment on the inside of a cover or opposite leaf of the book.

In another form of the invention, an envelope or jacket-type holder is adhesive-backed for fastening to an inside of the book, and the tabs are mounted on a release coating on the outside of the envelope-pocket. Learning key cards, each with individual numbers corresponding to the tabs, are inserted in the pocket so that an entire card is available for notes in reference to the corresponding tab.

The more refined model combines a pocket, note cards and the detachable "tips" all into one packet to be attached via adhesive on its back to an inside of the book for immediate use.

This allows for more copious note-taking. Each "tip" is easily removable and has pressure-sensitive adhesive on half of one side for marking the page and/or paragraph. The note cards are sub-classified with either numbers or letters. The purpose of the present invention is to help organize knowledge in useful ways. The present invention uses markers to identify significant passages or sections, to classify or link categories, and to identify passages for frequent and ready referral. One writes in the marker in the front of the book some detail of each identified passage or section. For best learning results one uses the markers to identify material he wishes to learn, writes brief descriptions of that in the key in the front of a book and then 1 hour later reviews his material.

The combined markers and note recording cards of the present invention make learning easier with less effort and increase one's ability to recall and use what has been read. The system of the present invention personalizes books with self-made notes and comments contained together for rapid review. The markers are removable and will not deface books. They may be used on library or borrowed books. One can expect higher resale value for used texts by removing the markers and adhesive-backed note packages. The notes become a permanent part of one's own library for easy filing and recording of information and for ready availability for review.

A selection of markers is offered in various packages for different uses and purposes, and they are available in a variety of colors. A small kit offers 1 to 30 tips, middle size 1 to 60 and a large package 1 to 100 tips. Special kits are offered with a hollow plastic tip in a larger size so the user can write in his own headings.

The product of the invention consists of two related parts: the marker tip, which is a tab that is coated on approximately one-half of one side with a pressure sensitive adhesive. That is used by inserting it along the edge of a page in a book, magazine or other printed material. It is inserted in such a way that about half the tab is visible when the book is closed.

The specified adhesive is one that readily may be removed from the surface of the page without leaving any residue or discoloration and has minimal deleterious effects on the paper. The adhesive quality is such that it will adhere to the page over an extended period of time if left permanently inserted in the book. The markers vary in size, shape and color. The marker tips may be made of paper or plastic or a plastic coated paper. The markers may come numbered, or alphabetized, or plain (so that they may be written upon) or as hollow plastic tabs, so that labels may be inserted. The numbers or letters may appear on one or both sides of the tabs. The markers may come packaged in different quantities and/or singly or in combinations of colors, shapes and sizes.

The markers may be packaged with a convenient protective strip over the adhesive area for protection until used (as on a "Band-Aid"). This protective cover is readily removable so that the tab is instantly ready for insertion on the page.

The marker is inserted in the book to identify a certain page, paragraph or sentence. The markers are attached along the edges of the pages of the book in an orderly index fashion to identify certain pages, or the markers are attached in such a way as to identify specific paragraphs or sentences.

The second related part of the invention is a coded index of one or more pages with lined blank spaces which may be written upon, or an envelope containing coded file cards with lined blank spaces which may be written upon. The index or envelope has a backing of strips of pressure sensitive adhesive of the same specifications as used on the "tip".

The coded index or envelope containing the coded cards may be inserted in the front, back or on a "flyleaf" of a book. The envelope is of such a size to accommodate one of the following size coded cards:

3 × 5 inches
4 × 6 inches
5 × 8 inches

The purpose for the coding of the markers and the index is so that a convenient cross-reference is made available to the user in organizing the information to which he wants ready access.

In one embodiment of the invention a plurality of page markers are provided. Each page markers is generally rectangular in shape and has identification means readable in opposite directions on opposite sides of one-half of the marker. An attaching means, which is preferably a pressure-sensitve adhesive, is secured to one-half of one face of each marker in a position remote from the identification means. The adhesive means may be any well-known adhesive which permanently attaches to paper and which is readily releasable from a shiny release coating such as a coating on a peelable release sheet. The identification means in a preferred embodiment occupies one-half of the marker, an area that is substantially square, and the adhesive attaching means occupies approximately one-half of the marker in an area that is substantially square.

A key card means is configured for attaching to a book, preferably within a book, and usually on the inside of the front or rear cover or on a flyleaf. In a preferred embodiment, the key card means has a pressure-sensitive adhesive on a rear face. The front face of the key card means may be lined, or otherwise sectioned, with identification means corresponding to marker identifications associated with each section.

In a preferred embodiment, a marker mounting means is connected to the key card means for holding the markers before the markers are attached to edges of pages. A person, before reading a book, mounts a key card means within the book. Then, as a person reads a book and notices parts which he wishes to mark, he removes a marker from the marker-holding means connected to the key card means and places the marker adjacent the passage in the book which he wishes to mark. Then he writes notes on the key card means at a position associated with the identification number of the marker. As an example, the key card means may be a single card with lines and identification numbers on its face. A coating may be placed on a portion of the card to hold adhesive markers until the markers are pulled from the coating for positioning on a page. One part of the card is free of coating so that notes may be written on that part.

In a preferred embodiment of the invention, the key card means is an envelope having a rear face covered by a pressure-sensitive adhesive mounting means with a peelable release sheet for guarding the adhesive mounting means until ready for use. The front face of the key card means envelope has a release coating for temporarily securing the markers until they are used on the pages. Included in the key card means envelope are plurality of cards, each marked with an identification corresponding to an identification on a marker. When a marker is attached to a page by a passage, the card corresponding to that marker is removed from the envelope, notes are placed on that card, and the card is returned to the envelope.

The markers are constructed so that the markers may be attached to book pages to mark the entire page, in which case the markers are arranged in a neat, progressive order on the book. The markers are also capable of being used to identify particular passages on a page, in which case the markers are attached to the pages according to the position of the passage to be marked.

One object of the invention is the provision of book notation system apparatus comprising a plurality of page markers having identification means for identifying individual markers, the markers having attaching means for attaching the markers to pages of a book, and key card means for receiving information related to individual markers, the key card means having identification means related to the marker identification means, and the key card means having mounting means for mounting the key card means in a book remote from marker marker means are attached to edges of pages.

Another object of the invention is the provision of the book notation system apparatus with double-sided markers, having marker identification means mounted in different directions on opposite sides of the markers, and having adhesive attaching means applied to one-half of one face of each marker remote from the identification means.

A further object of the invention is the provision of a book notation system apparatus wherein markers are rectangular, wherein the identification means occupies one-half of each marker, and wherein the adhesive attaching means occupies one-half of one face of the marker.

The invention has as another object the provision of book notation system markers wherein the identification area is substantially square and wherein the attaching means occupies a substantially square area on one face of the marker.

Another object of the invention is the provision of a book notation system apparatus comprising a mounting card means for holding markers before the markers are placed on edges of pages, the mounting card means having an adhesive means on one face of the card and having a release coating on an opposite face of the card for releasably holding the attaching means of the markers.

Another object of the invention is the provision of a book notation marking apparatus wherein the note-receiving key card means and a marker mounting card means are connected.

The invention has as another object the provision of a book notation apparatus wherein a marker mounting means is on a frontal surface of a note-receiving key card means opposite the mounting means on a rear surface of the key card means.

A further object of the invention is the provision of a book notation system apparatus with a key card means comprising an envelope having a rear face on which a key card mounting adhesive is arranged for attaching the key card means to the book, and having a front face on which a marker mounting means is arranged for mounting a plurality of markers before use on pages of the book, and having a plurality of cards in a pocket in the envelope, each of the cards being identified with an identification corresponding to each of the markers.

This invention has as a further object the provision of a book notation system apparatus wherein a note-receiving key card means comprises a card having an adhesive back and a plurality of lines individually identified by identification means associated with the lines for individually relating to a plurality of markers.

These and further and other objects of the invention are apparent in the disclosure which includes the above and following specification and claims and the drawings.

DETAILED DESCRIPTION OF THE DRAWINGS

Figure 1:
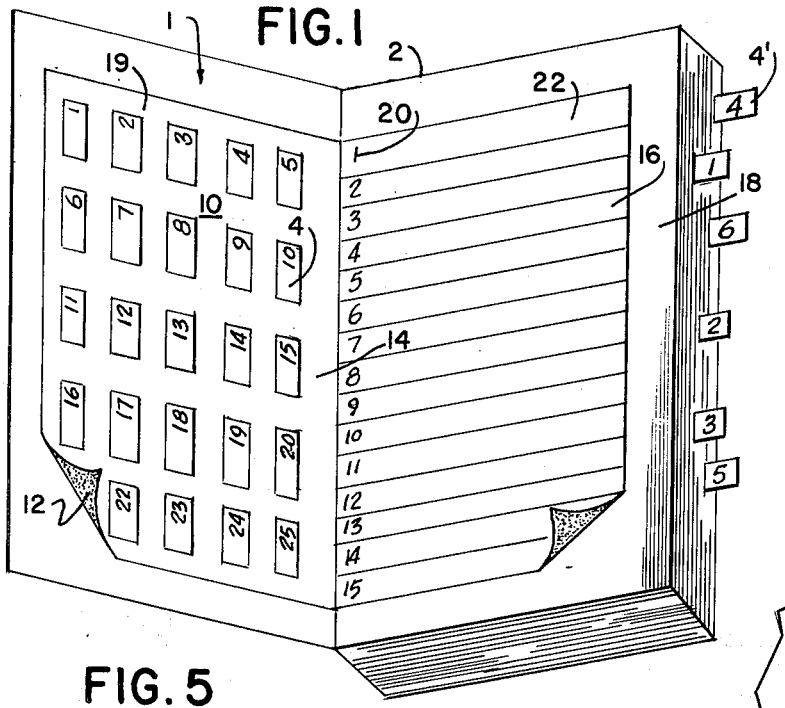
FIG. 1 is a perspective view of a book on which markers have been mounted, showing the key card means and the marker mounting means inside the cover of the book.

Referring to FIG. 1, a book notation system apparatus is generally indicated by the numeral 1. The apparatus is mounted on a book 2. A plurality of markers 4 are mounted on the apparatus for removal and use by removal from the marker mounting means and by attachment to edges of pages as indicated at 4′.

Figure 2:
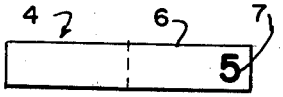
FIG. 2 is a front elevational view of a single marker.
Figure 3:
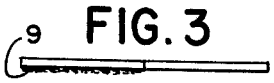
FIG. 3 is an edge elevation of the marker of FIG. 2.
Figure 4:
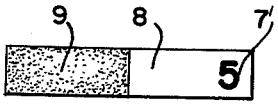
FIG. 4 is a rear elevation of the marker of FIGS. 2 and 3.

As shown in FIGS. 2, 3 and 4, the markers 4 have a front face portion 6 on which identification numbers 7 appear. As shown in FIGS. 3 and 4, adhesive 9 is applied to half of the rear face. The other portion 8 of the rear face has a numerical identification 7′ which is oppositely directed to the identification 7 on the front face. That permits the markers to be positioned directly adjacent the passage to be marked in a book.

Referring to FIG. 1, in one embodiment, the markers 4 are mounted on a marker mounting card 10 before the markers are detached for attaching to edges of the pages. The marker mounting means 10 has an adhesive back 12 and has a front face 14 which holds the markers in numerical order. In FIG. 1 all of the markers are shown mounted on the card for clarity, notwithstanding that markers 1–6 have been removed for attaching to the edges of pages. The marker holding means is attached to the key card means 16. An adhesive backing on key card 16 is secured to a flyleaf 18 of the book. In a preferred embodiment of the invention, a release coating 19 on the face of marker holding card 14 releasably holds the adhesive 9 of the markers until the markers are ready to be removed for attaching to pages of the book.

On the key card 16 numbers 20 identify note-taking spaces 22 which are associated with like numbered markers 4′ on edges of the pages.

Figure 5:
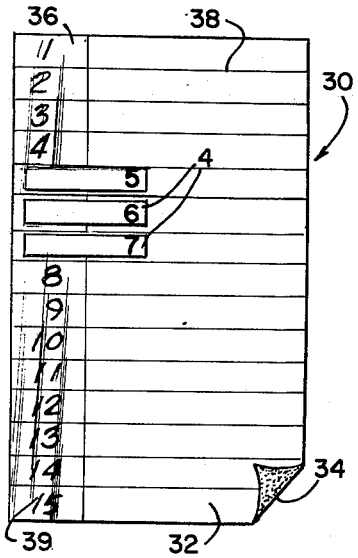
FIG. 5 is an example of a card constructed according to the invention, in which the key card means has associated therewith a marker mounting means for holding the markers until they are affixed to edges of pages of a book.

An alternate key card means 30 is shown in FIG. 5. The key card 32 has an adhesive backing 34 and has a coated side area 36 for releasably receiving the adhesive 9 of the markers. Note-taking areas 38 are left uncoated, and the numbers 39 associated with those areas are visible through the transparent release coating.

Figure 6:
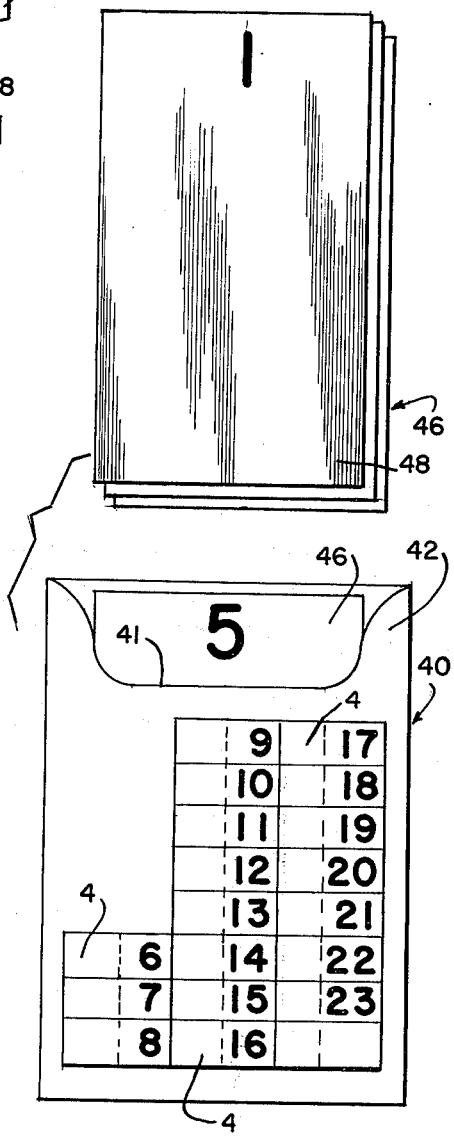
FIG. 6 shows a preferred embodiment of the invention in which the key card means is an adhesive-backed envelope with a face for mounting markers until they are used in the book and with a pocket which receives cards on which notes are written.

In the preferred form of the invention shown in FIG. 6, the key card means comprises an envelope 40 having a pocket 41. A front face 42 of the envelope is coated with a slippery surface for holding markers 4 until they are ready to be used on the book. A rear face of the envelope is covered with an adhesive coating for mounting the envelope on the inside of a cover or on a flyleaf of a book.

A plurality of cards 46 are included in the key card means. The cards are slipped out of the pocket 41 and notes are written on the faces 48 of the individual cards, and the cards are returned to the envelope, permanently mounting the notes in the book.

Figure 7:
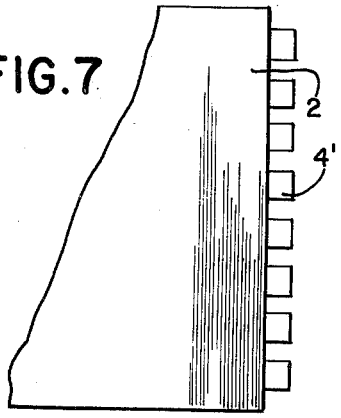
FIGS. 7 and 8 show front and side views of markers arranged in order in a book.
Figure 8:
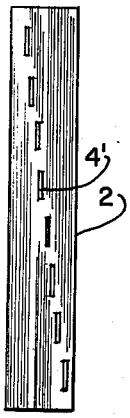

FIGS. 7 and 8 show the mounting of markers 4′ on pages of a book to identify whole pages. In that embodiment, the markers are arranged in numerical order for ease of locating the particular markers.

Figure 9:
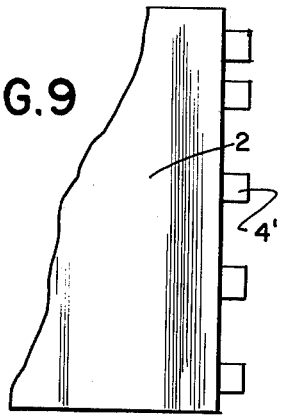
FIGS. 9 and 10 show front and side views of markers arranged in a book to mark selected passages on pages.
Figure 10:
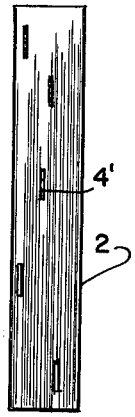

FIGS. 9 and 10 show the markers 4′ attached to edges of pages of a book 2. In the 9 and 10 figures, the markers have been randomly arranged on the pages, to indicate that the markers are positioned directly by passages on the pages which are being marked.

While the invention has been described with reference to specific embodiments, it will be obvious to those skilled in the art that variations and modifications of the invention may be made without departing from the scope of the invention. The scope of the invention is defined in the following claims.

I claim:

1. A book notation system apparatus comprising a plurality of page markers having identification marks for identifying individual markers, the markers having adhesive attaching means for attaching the markers to pages of a book, separate key card means for receiving information related to individual markers, the key card means having a front face and a rear face and release coating marker-holding means on the front face of the key card means, for holding the markers by the adhesive attaching means, the key card means having identification means related to the marker identification marks and having areas for writing notations along the identification means, and the key card means having mounting means on the rear face for mounting the key card means in a book remote from marker means which are attached to edges of pages.

2. The book notation system apparatus of claim 1 wherein the markers comprise double-sided markers, wherein the marker identification marks are mounted in different directions on opposite sides of the marker and wherein the attaching means comprises an adhesive applied to one-half of one face of the marker remote from the identification marks.

3. The apparatus of claim 2 wherein the marker is rectangular, wherein the identification marks occupies an area one-half of the marker, and wherein the attaching means occupies one-half of one face of the marker.

4. The apparatus of claim 3 wherein the identification area is substantially square and wherein the attaching means occupies a substantially square area on one face of the marker.

5. The apparatus of claim 1 the marker holding means further comprising a mounting card means for holding markers before the markers are placed on edges of pages, the mounting card means having an adhesive means on one face of the card and having a release coating on an opposite face of the card for releasably holding the attaching means of the markers.

6. The apparatus of claim 5 wherein the key card means and marker mounting card means are connected.

7. The apparatus of claim 6 wherein the marker mounting means is on a frontal surface of the key card means opposite the mounting means on a rear surface of the key card means.

8. The apparatus of claim 7 wherein the key card means comprises an envelope having a rear face on which the key card mounting means is arranged for attaching the key card means to the book and having a front face on which the marker mounting means is arranged for mounting a plurality of markers before use on pages of the book and the identification means comprising a plurality of cards in a pocket in the envelope, each of the cards being identified with an identification corresponding to each of the markers.

9. The apparatus of claim 4 wherein the key card means comprises a card having an adhesive back and a plurality of lines individually identified by identification means associated with the lines for individually relating to the markers.

10. The book notation system apparatus of claim 1 wherein the key card mounting means comprises adhesive on one page of the key card means, and further comprising a marker release coating on a face of the key card means spaced from the first face for releasably holding the markers.

* * * * *